US007762419B2

(12) United States Patent
Suga

(10) Patent No.: US 7,762,419 B2
(45) Date of Patent: Jul. 27, 2010

(54) CAP MOUNTING ARRANGEMENT

(75) Inventor: Takeharu Suga, Hiroshima (JP)

(73) Assignee: Daikyonishikawa Corporation (JP)

( * ) Notice: Subject to any disclaimer, the term of this patent is extended or adjusted under 35 U.S.C. 154(b) by 0 days.

(21) Appl. No.: 12/412,594

(22) Filed: Mar. 27, 2009

(65) Prior Publication Data

US 2009/0184122 A1 Jul. 23, 2009

Related U.S. Application Data

(62) Division of application No. 11/058,358, filed on Feb. 16, 2005, now Pat. No. 7,530,467.

(30) Foreign Application Priority Data

Dec. 26, 2003 (JP) ..... 2003-433014
Sep. 17, 2004 (JP) ..... 2004-271888

(51) Int. Cl.
*B65D 43/10* (2006.01)
*B65D 41/16* (2006.01)

(52) U.S. Cl. ..... 220/281; 215/216; 215/293; 220/792; 220/788

(58) Field of Classification Search ..... 220/300, 220/281, 326, 792, 788; 215/213, 211, 216, 215/224, 225, 293, 294
See application file for complete search history.

(56) References Cited

U.S. PATENT DOCUMENTS 1,399,345 A 12/1921 Paul
1,599,285 A 9/1926 Reid
1,682,367 A 8/1928 Brawn
3,215,298 A * 11/1965 Shaffer ..... 215/270
3,964,634 A * 6/1976 Jasinski et al. ..... 220/281
3,995,765 A * 12/1976 Burke ..... 220/281
4,588,097 A * 5/1986 Hauser ..... 215/216
4,676,370 A 6/1987 Rudick
4,790,442 A * 12/1988 Gach ..... 215/216
5,267,667 A 12/1993 Cozzani
5,372,275 A 12/1994 Yeh
5,529,201 A 6/1996 Tallent et al.

(Continued)

FOREIGN PATENT DOCUMENTS

JP 2002-106530 4/2002

(Continued)

*Primary Examiner*—Anthony Stashick
*Assistant Examiner*—Niki M Eloshway
(74) *Attorney, Agent, or Firm*—Studebaker & Brackett PC; Donald R. Studebaker

(57) ABSTRACT

A cap has a pair of L-shaped, flexible engaging arms that extend, from the end of a cap body opposite to the direction of fitting, in the direction of fitting with a distance away from the cap body. The distal ends of the engaging arms are connected by a pair of flexible connecting bridges to surround the outer periphery of the cap body with a distance away therefrom. The cap body is fitted into a cylindrical part of a cylinder head cover and engaging projections of the pair of engaging arms are engaged with an engaging recess in the outer periphery of the cylindrical part. The engaging arms are flexed to get away from the outer periphery of the cylindrical part by pushing circumferentially middle parts of the connecting bridges to come close to each other, so that the engaging projections are disengaged from the engaging recess.

4 Claims, 12 Drawing Sheets

U.S. PATENT DOCUMENTS 5,687,863 A * 11/1997 Kusz ..... 215/216
5,722,546 A * 3/1998 Briere ..... 215/216
5,860,543 A * 1/1999 Decelles ..... 215/209
6,039,196 A * 3/2000 Ekkert et al. ..... 215/216
6,439,409 B1 * 8/2002 Dressel et al. ..... 215/228
2004/0182814 A1 * 9/2004 Suffa ..... 215/216
2006/0213860 A1 * 9/2006 Robinson ..... 215/216

FOREIGN PATENT DOCUMENTS

JP 2003-081316 3/2003

* cited by examiner

CAP MOUNTING ARRANGEMENT

CROSS-REFERENCE TO RELATED APPLICATION

This application is a Divisional of application Ser. No. 11/058,358 filed Feb. 16, 2005.

This application claims priority under 35 USC 119 to Japanese Patent Application No. 2004-271888, filed on Sep. 17, 2004, the entire contents of which are incorporated herein by reference.

BACKGROUND OF THE INVENTION (a) Field of the Invention

This invention relates to a cap mounting arrangement in which a cap with a sealing member is detachably attached to a container to hermetically closes an opening of the container.

(b) Description of Related Art

Cap mounting arrangements of this type have conventionally been used, for example, for oil caps for engine oil filling provided on cylinder head covers in automobile engines. These oil caps are generally of a screw type which is fitted with an O-ring as a sealing member and closes an opening of a cylinder head cover by screwing internal threads formed on the opening of the cylinder head cover with external threads formed on the oil cap.

For example, a cap mounting arrangement in which a cap opens/closes an opening serving as an engine oil inlet is disclosed in Japanese Unexamined Patent Publication No. 2003-81316 (page 2 and FIG. 1). The cap is of a screw type formed of a plug having external threads on its outer periphery and a flange formed at one end of the plug. The cap opens or closes the opening by turning the flange grasped with one hand to screw the plug into or out of the opening.

In hermetically closing the opening with the cap in the above cap mounting arrangement, however, the plug cannot be screwed into the opening unless the external threads of the plug are properly mated with the internal threads of the opening. In such a case, the need is to detach the plug from the opening and try the closing (plug turning) again, which deteriorates workability. Further, when the cap has been tightly screwed on in order to avoid oil leakage through the opening, it is difficult to screw off the cap and a strong turning force is needed for cap removal.

In the meantime, resin molded articles have been dominating as cylinder head covers and oil caps for the purpose of weight reduction or other purposes. With resin molded articles, the internal threads on the inner surface of the opening have undercut profiles when molded, which produces the need for using a mold having a sliding platen or a rotating platen. This results in raised mold cost.

Therefore, there is a need for a cap mounting arrangement in which a cap with a sealing member can open and close the opening of a container without providing internal and external threads as described above.

A known cap mounting arrangement in which a cap is inserted into an opening without providing internal and external threads is disclosed, for example, in Japanese Unexamined Patent Publication No. 2002-106530, though it is different in use from the first-mentioned cap mounting arrangement. In this arrangement, a mounting member for fixing a part to a vehicle body is formed with engaging holes and a slit extending in an axial direction, and a cap insertable into the mounting member is provided with engaging extensions for the engagement with the engaging holes and an engaging pin insertable into the slit. In mounting the cap to the mounting member, the engaging pin is engaged with the slit at its intermediate part so that the cap can be prevented from undesirably getting out of the mounting member.

SUMMARY OF THE INVENTION

With the above cap mounting arrangement, the cap can be inserted into the opening without providing internal and external threads and can be held engaged with the mounting member. This arrangement, however, does not take into consideration the detachment (removal) of the engaged cap from the opening. Therefore, this arrangement cannot be applied to cap mounting arrangements for opening and closing the opening of a container. Further, in this arrangement, since the inner surface of the cap inserting cylinder constituting part of the mounting member is formed with the engaging holes for the engagement with the engaging extensions of the cap, a mold for forming the engaging holes must include a sliding platen.

The present invention has been made in view of the above problems and therefore its basic object is to provide a cap mounting arrangement whereby a cap can easily be attached to and detached from a container.

Another object of the present invention is to provide an inexpensive, easy-to-attach/detach cap mounting arrangement in which the structure for engaging the cap with the container opening is well designed so that a part thereof for receiving the cap is provided with neither threaded portion nor engaging hole, thereby eliminating the need for a sliding platen for the molding of the part for receiving the cap.

In order to achieve the above objects, the present invention provides, instead of a screw type cap, a cap that can be attached to and detached from a container simply by straightly pushing it into and pulling it out of the opening.

Specifically, the present invention is first directed to a cap mounting arrangement comprising a cylindrical part integrally extended from a container to have an opening and a cap detachably attached to the cylindrical part to hermetically close the cylindrical part, and the cap mounting arrangement is characterized by the following solution.

The cap comprises: a cap body fitted into the cylindrical part through a sealing member; a pair of L-shaped, flexible engaging arms that extend radially outwardly from two opposite points existing on a circumferential edge of the outer periphery of the cap body opposite to the direction of fitting and equally away from the center of the cap body and then extend in the direction of fitting from the radially outwardly extending ends of the engaging arms with a distance away from the outer periphery of the cap body, the distal ends of the engaging arms having engaging projections, respectively, engaged with an engaging recess formed in the outer periphery of the cylindrical part; and a pair of flexible connecting bridges that connect the distal ends of the pair of engaging arms to surround the outer periphery of the cap body with a distance away therefrom, and the cap mounting arrangement is configured so that in attaching the cap to the cylindrical part, the fitting of the cap body into the cylindrical part and the engagement of the engaging projections of the pair of engaging arms with the engaging recess are carried out by pushing an end of the cap body opposite to the direction of fitting, and that in detaching the cap from the cylindrical part, the pair of engaging arms are flexed to get away from the outer periphery of the cylindrical part to disengage the engaging projections from the engaging recess of the cylindrical part by pushing circumferentially middle parts of the pair of connecting bridges together to come close to each other.

With the above cap mounting arrangement, in attaching the cap to the cylindrical part, the fitting of the cap body into the cylindrical part and the engagement of the engaging projections of the pair of engaging arms of the cap are accomplished simply by aligning the cap appropriately with the opening of the cylindrical part and pushing it down. Therefore, the cap can easily be attached to the cylindrical part with a one-touch operation. On the other hand, in detaching the cap from the cylindrical part, the pair of engaging arms are flexed to get away from the outer periphery of the cylindrical part simply by radially inwardly pushing the circumferentially middle parts of the pair of connecting bridges together to come close to each other, and the engaging projections are thereby disengaged from the engaging recess of the cylindrical part. Therefore, the cap can easily be detached from the cylindrical part with a one-touch operation.

In one aspect of the above cap mounting arrangement, the distance between the circumferentially middle parts of the pair of connecting bridges and the outer periphery of the cap body is set larger than the distance between the pair of engaging arms and the outer periphery of the cap body.

With this configuration, the pair of connecting bridges has an elliptic shape as a whole, their circumferentially middle parts are located on the longer diameter of the ellipse, and the distance between the circumferentially middle parts of the pair of connecting bridges and the outer periphery of the cap body is set larger than the distance between the pair of engaging arms and the outer periphery of the cap body. Therefore, the circumferentially middle parts can be flexed largely with a slight pushing force. As a result, the distal ends of the engaging arms are flexed to get well away from the outer periphery of the cylindrical part, which ensures that the engaging projections are disengaged from the engaging recess of the cylindrical part.

In another or further aspect of the above cap mounting arrangement, the cap body is configured so as to be fitted into the opening of the cylindrical part.

With this configuration, the cap body is fitted into the opening of the cylindrical part, thereby pressing the cylindrical part from inside to outside (i.e., in a direction in which the engaging recess of the cylindrical part approaches the engaging projections of the engaging arms). This ensures that the engaging projections of the engaging arms are engaged into the engaging recess of the cylindrical part, which certainly prevents the cap from being undesirably dislodged from the cylindrical part.

Further, in order to achieve the above objects, the present invention provides a cap mounting arrangement in which a cap can be engaged into an opening of a container by pressing the cap into the opening and can be removed from the opening by turning and pulling it up.

Specifically, the present invention is also directed to a second cap mounting arrangement in which a cap with a sealing member is detachably attached to a container to hermetically close an opening of the container, and the second cap mounting arrangement is characterized by the following solution.

The cap comprises an insert part having a cylindrical shape closed at one end and a flange provided at said closed one end of the insert part, the insert part has a radially expandable and contractible engaging part that extends radially outwardly from the distal end of the outer periphery of the insert part and a sealing groove that is formed in the outer periphery of the insert part between the engaging part and the flange to receive the sealing member, the opening of the container is provided with a cylindrical part into which the insert part of the cap is tightly inserted with the engaging part contracted radially inwardly, and the inner periphery of the cylindrical part has an engaging groove including: a deepest part that engages with the engaging part with the engaging part expanded radially outwardly when the cap is attached to the cylindrical part; and a guide extending to gradually decrease its radial depth from the deepest part in a circumferential direction so that when the cap is turned for removal, the engaging part engaged in the deepest part can be contracted radially inwardly to allow the cap to be removed.

With the second cap mounting arrangement, the insert part of the cap is tightly inserted into the cylindrical part formed at the opening of the container with the engaging part extending from the distal end of the outer periphery of the insert part contracted radially inwardly. The insert part is further pushed in until the engaging part is engaged in a radially outwardly expanded manner into the deepest part of the engaging groove in the inner periphery of the cylindrical part, so that the cap can be attached to the cylindrical part. Further, through the turning of the cap, the engaging part engaged in the deepest part is contracted radially inwardly by the guide so that the cap can be removed from the cylindrical part. Therefore, the cap can be engaged with the opening of the container and held engaged therewith simply by inserting the cap into the opening without turning it. In the removal of the cap, through a slight turning of the cap, the engaging part is contracted radially inwardly and thereby disengaged from the engaging groove to cancel the engagement of the engaging part. As a result, the cap can be pulled out of and removed from the cylindrical part. In this way, the cap can be attached to the cylindrical part simply by inserting the cap into the cylindrical part, and the cap can be detached from the cylindrical part simply by slightly turning the cap and pulling it up. This provides a cap mounting arrangement with an extreme ease of cap attachment and detachment. Furthermore, since the cylindrical part receiving the cap is formed with neither threaded part nor engaging hole, there is no need for a sliding platen for the mold for forming the inner surface of the cylindrical part. This provides an inexpensive cap mounting arrangement.

In one aspect of the second cap mounting arrangement, the external end of the inner periphery of the cylindrical part has an inserting recess that extends to gradually decrease its radial depth toward the deepest part of the engaging groove, thereby guiding the engaging part toward the deepest part during insertion of the cap into the cylindrical part.

With this configuration, during insertion of the cap into the cylindrical part, the engaging part of the cap can be guided towards the deepest part of the engaging groove by the inserting recess formed at the external end of the inner periphery of the cylindrical part. Therefore, the cap can be inserted into the opening of the container with greater ease and the engaging part of the cap can be engaged into the deepest part with greater reliability.

In another or further aspect of the second cap mounting arrangement, one of the back side of the flange of the cap and the external end surface of the cylindrical part has a push-out projection for pushing the cap toward outside the cylindrical part, and the other of the back side of the flange of the cap and the external end surface of the cylindrical part has a receiving recess including: a bottom capable of accommodating the push-out projection; and a projection climbing surface raised from the bottom so that after the engaging part of the cap engaged in the deepest part of the engaging groove of the cylindrical part is disengaged from the engaging groove through the turning of the cap, the push-out projection pushes the cap toward outside the cylindrical part.

With this configuration, in pulling the cap out of the opening of the container by turning it, the engaging part of the cap engaged into the deepest part of the engaging groove of the cylindrical part is first disengaged from the engaging groove and the push-out projection on one of the back side of the flange of the cap and the external end surface of the cylindrical part is then climbed on the projection climbing surface of the receiving recess in the other, so that the cap can be pushed out toward outside the cylindrical part. In this way, the cap is slightly pushed out toward outside the opening of the container using a force to turn the cap. Therefore, the cap can easily be pulled out.

DESCRIPTION OF THE PREFERRED EMBODIMENTS

Embodiments of the present invention will be described below with reference to the drawings.

Embodiment 1

Cap Mounting Arrangement

Figure 1:
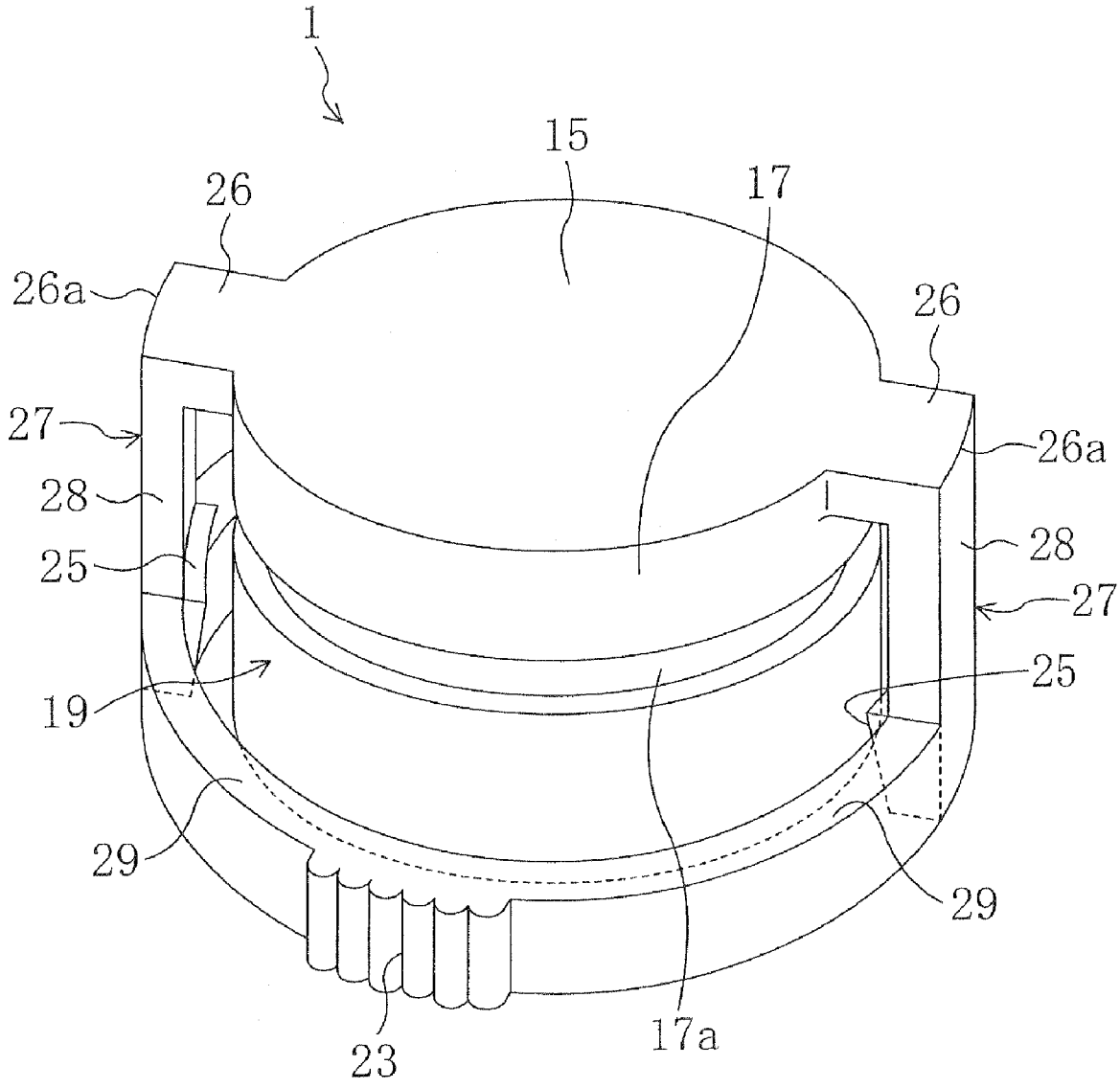
FIG. 1 is a perspective view of a cap according to a first embodiment of the present invention.
Figure 2:
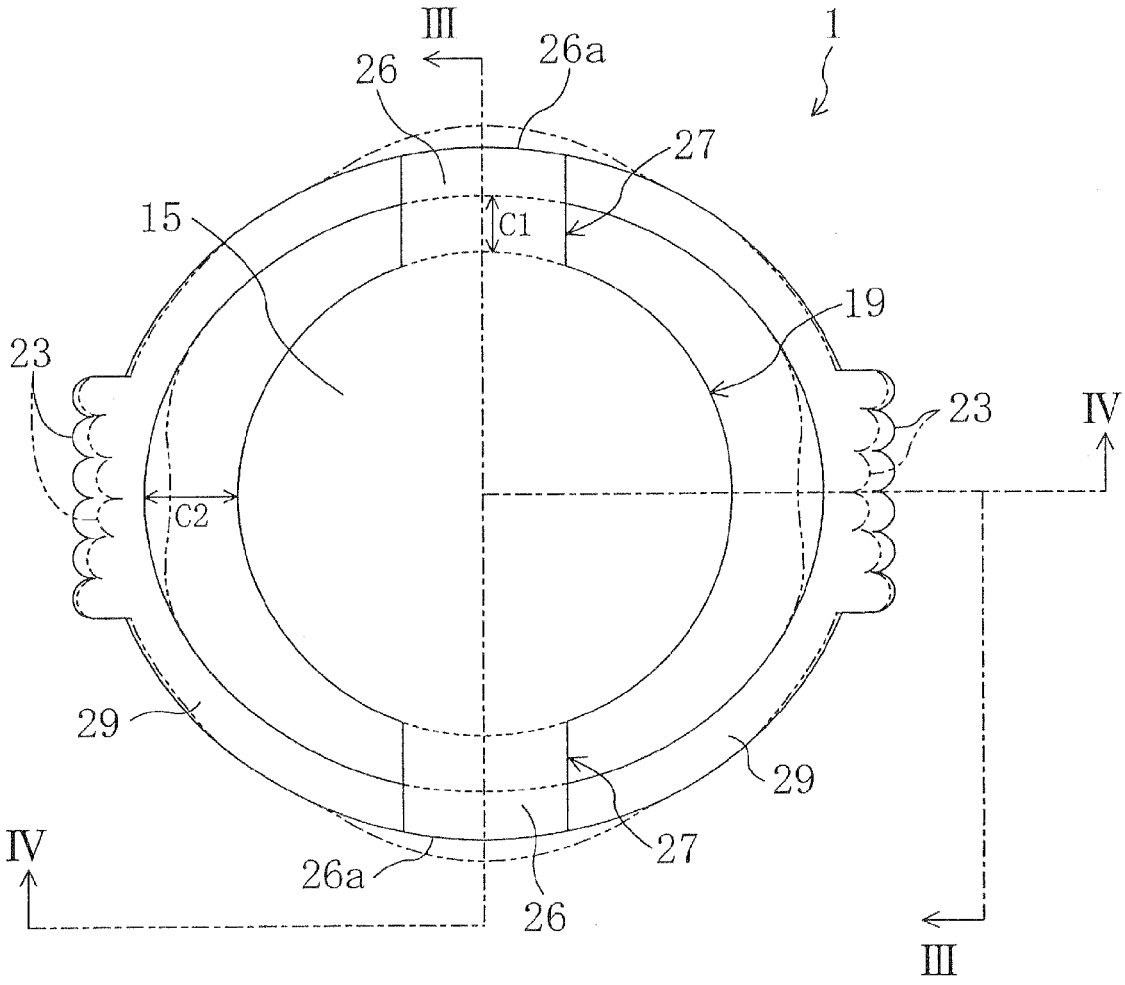
FIG. 2 is a plan view of the cap.
Figure 3:
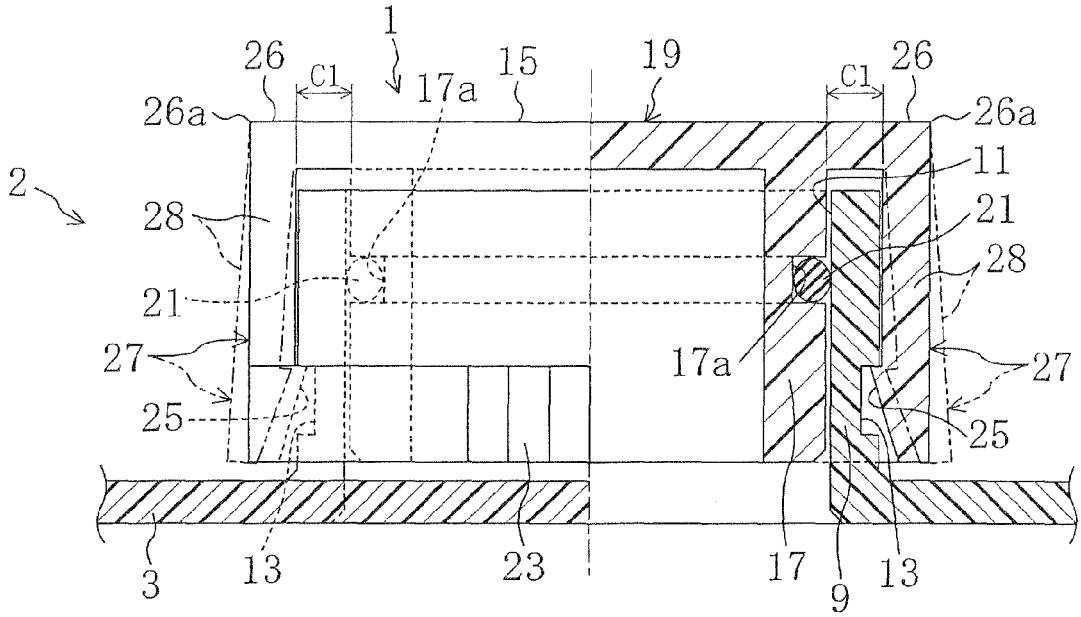
FIG. 3 is a cross-sectional view taken along the line III-III of FIG. 2, which shows how the cap is attached to a cylindrical part of a cylinder head cover.
Figure 4:
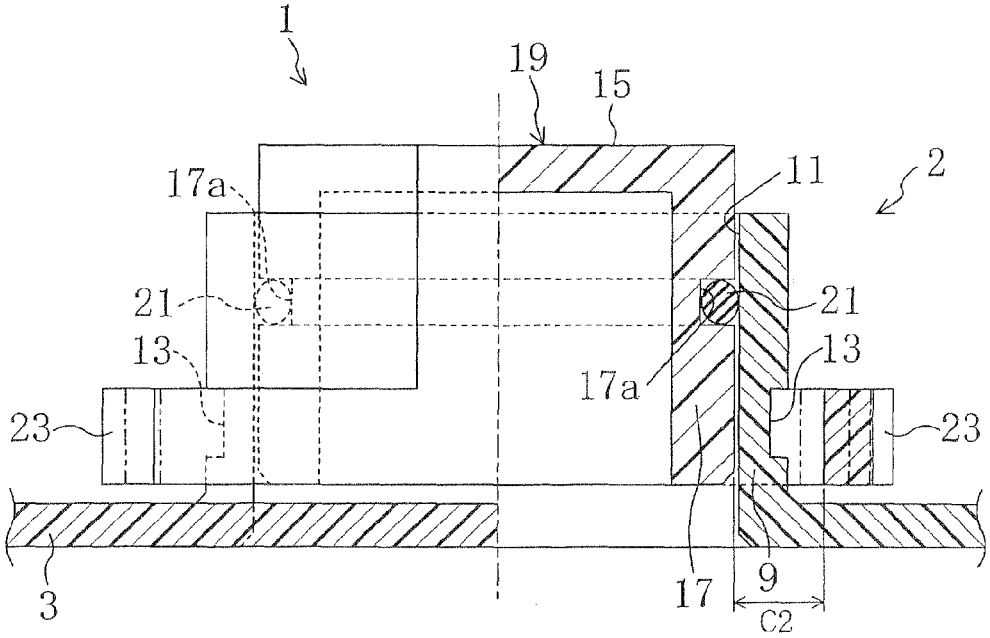
FIG. 4 is a cross-sectional view taken along the line IV-IV of FIG. 2, which shows how the cap is attached to the cylindrical part of the cylinder head cover.
Figure 5:
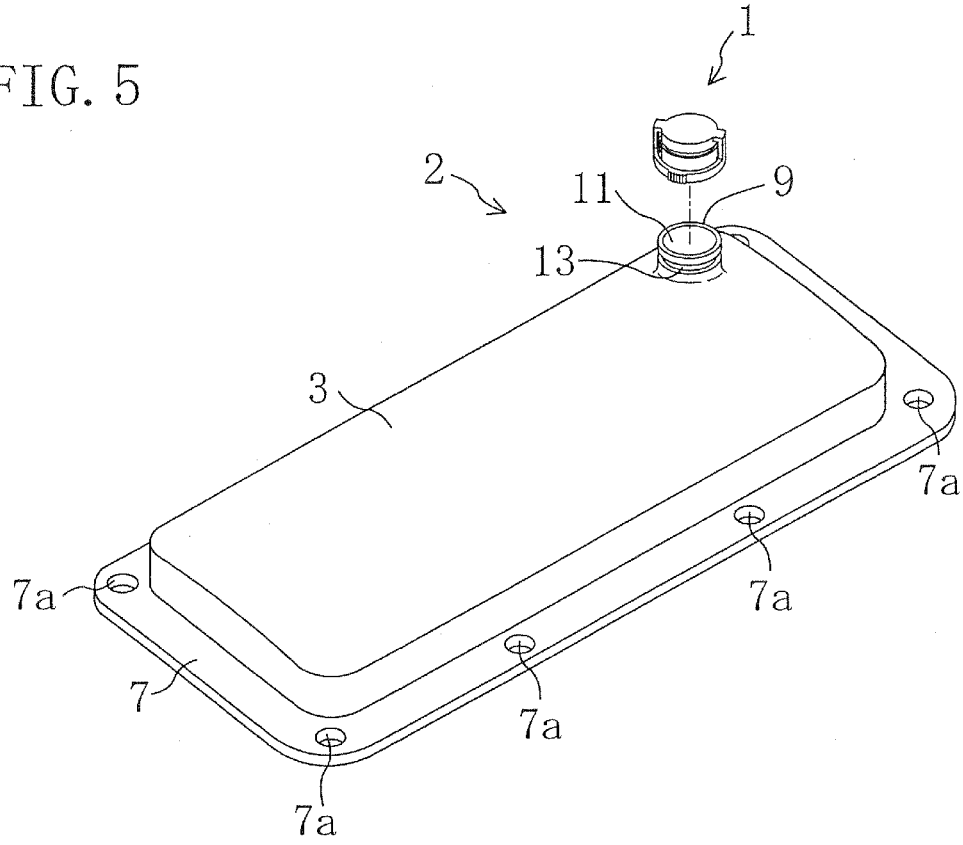
FIG. 5 is a perspective view showing the cap and the cylinder head cover according to the first embodiment before the cap is attached to the cylindrical part of the cylinder head cover.

FIG. 5 shows a cap mounting arrangement 2 according to a first embodiment of the present invention. The cap mounting arrangement 2 is for mounting a cap 1 for engine oil filling to a cylinder head cover 3 in a vehicle engine (not shown). The cylinder head cover 3 and the cap 1 are resin molded articles. The cylinder head cover 3 is for covering a cylinder head (not shown) for an engine and forms a container with the cylinder head.

The cylinder head cover 3 has a rectangular plate shape and a flange 7 is extended around its outer peripheral edge. The flange 7 is formed with a plurality of bolt through holes 7*a* spaced at perimetrically regular intervals. The cylinder head cover 3 can be attached to the cylinder head by inserting bolts (not shown) into the bolt through holes 7*a* and screwing them into screw holes, respectively, of the engine cylinder head. A cylindrical part 9 for pouring engine oil therethrough into the cylinder head is formed integrally with the cylinder head cover 3 at one of four corners. The cylindrical part 9 has an opening 11 passing through the cylinder head cover 3 from outside to inside. Further, an engaging recess 13 in the form of an annular groove of substantially U-shaped cross section is recessed in part of the outer periphery of the cylindrical part 9 located toward the cylinder head cover 3. Note that the engaging recess 13 is not limited to the annular groove but may comprise rectangular depressions recessed to correspond to engagement positions for the later-described pair of engaging arms 27. In such a case, marks indicating the positions of the rectangular depressions are preferably added to the surface of the cylinder head cover 3.

The cap 1 comprises, as shown in enlarged detail in FIGS. 1 to 4, a bottomed cylindrical cap body 19 consisting of a flat part 15 and a cylindrical part 17 formed integrally with the outer peripheral edge of the flat part 15. An annular sealing groove 17*a* of substantially U-shaped cross section is recessed substantially in the axial middle of the outer periphery of the cylindrical part 17 of the cap body 19. A sealing member, for example, a rubber-made O-ring 21, is seated into the sealing groove 17*a*. The cylindrical part 17 of the cap body 19 is fitted through the O-ring 21 into the opening 11 of the cylindrical part 9 of the cylinder head cover 3, and in this fitting relationship the O-ring 21 is brought into close contact with the inner periphery of the cylindrical part 9 to hermetically close the opening 11. Note that the O-ring 21 is not given in FIG. 1 for the clarity of the sealing groove 17*a*.

At two opposite points existing on the peripheral edge of the flat part 15 of the cap body 19 on the opposite side of the cap body 19 to the direction of fitting and located equally away from the center of the cap body 19, i.e., at two opposite points that exists on the peripheral edge of the flat part 15, passes through the center of the cap body 19 and are disposed 180° apart, a pair of L-shaped, flexible engaging arms 27 are formed integrally with the cap body 19 to extend therefrom. More specifically, each engaging arm 27 is formed of a horizontal aim 26 horizontally outwardly extending from one of the two opposite positions, and a pendent arm 28 extending in the direction of fitting (downward) from an extending end 26*a* of the horizontal arm 26 so as to be parallel to and spaced a distance C1 away from the outer periphery of the cylindrical part 17 of the cap body 19. Further, a claw-like engaging projection 25 is formed on the inner side of the distal end (lower end) of the pendent arm 28 to correspond to the engaging recess 13 of the cylinder head cover 3 (cylindrical part 9). The distance C1 is set at a value at which the pendent arms 28 of the pair of engaging arms 27 are located outside the cylindrical part 9 when the cap 1 is attached to the cylindrical part 9 of the cylinder head cover 3. The distal ends of the pendent arms 28 of the pair of engaging arms 27 are connected to each other through a pair of flexible connecting bridges 29 to surround the outer periphery of the cylindrical part 17 of the cap body 19 with a distance therebetween. The connecting bridges 29 have an elliptical shape as a whole in a plan view. Push parts 23 are formed in the circumferential middles of the pair of connecting bridges 29, respectively. The pair of connecting bridges 29 are both elastically deformed by pinching the push parts 23 with fingers and pushing them to come close to each other, thereby allowing both the engaging projections 25 to get away from the cylindrical part 17 of the cap body 19. As a result, both the engaging projections 25 are released from engagement with the engaging recess 13. On the other hand, the distance C2 between the push parts 23 and the outer periphery of the cylindrical part 17 of the cap body 19 is set larger than the distance C1 between the dependent arms 28 of the engaging arms 27 and the outer periphery of the cylindrical part 17 of the cap body 19. In other words, the push parts 23 are located at both ends of the longer diameter of the ellipse, while the engaging arms 27 are located at both ends of the shorter diameter of the ellipse. The elliptical shape increases the degree of deformation of the connecting bridges 29 to facilitate the disengagement of the engaging projections 25 from the engaging recess 13.

Cap Attachment and Detachment

In attaching the thus formed cap 1 to the cylindrical part 9 of the cylinder head cover 3, the O-ring 21 is previously seated into the sealing groove 17*a* of the cylindrical part 17, the cap 1 is then grasped and put on the cylindrical part 9 with the cylindrical part 17 of the cap body 19 aligned with the opening 11 of the cylindrical part 9, the flat part 15 of the cap body 19 is pushed down to fit the cylindrical part 17 into the opening 11 of the cylindrical part 9. In the course of this pushing, the engaging arms 27 and connecting bridges 29 are elastically deformed as shown in the imaginary lines of FIGS. 2 to 4. Specifically, the engaging projections 25 of the pair of engaging arms 27 slide from the distal end to the other end of the outer periphery of the cylindrical part 9 of the cylinder head cover 3 while keeping close contact with it. Then, the engaging projections 25 are restored from the state shown in the imaginary lines of FIG. 3 to the state shown in the solid lines thereof to snap into the engaging recess 13. In the meantime, the pair of connecting bridges 29 are elastically deformed from the state shown in the imaginary lines of FIGS. 2 and 4 to the state shown in the solid lines thereof. In this way, the cap 1 can easily be attached to the cylindrical part 9 of the cylinder head cover 3 with a one-touch operation simply by pushing the flat part 15 of the cap 1.

In detaching the cap 1 from the cylindrical part 9 of the cylinder head cover 3, the push parts 23 of the pair of connecting bridges 29 are pinched with fingers and pushed together to come close to each other. Thus, the pair of connecting bridges 29 are elastically deformed as shown in the imaginary lines of FIGS. 2 and 4. As a result, the pair of engaging arms 27 are flexed outwardly to get away from the outer periphery of the cylindrical part 9 with the extending ends 26*a* as fulcrums as shown in the imaginary lines of FIGS. 2 and 3, so that the engaging projections 25 are disengaged from the engaging recess 13 of the cylindrical part 9. Then, with the push parts 23 held pushed together, the cap 1 is pull up to remove the cylindrical part 17 of the cap body 19 from the opening 11 of the cylindrical part 9 of the cylinder head cover 3. In this way, the cap 1 can easily be detached from the cylindrical part 9 of the cylinder head cover 3 with a one-touch operation simply by pulling the cap 1 up while pushing the push parts 23 of the pair of connecting bridges 29.

Further, since in the first embodiment the distance C2 between the push parts 23 of the pair of connecting bridges 29 and the outer periphery of the cylindrical part 17 of the cap body 19 is set larger than the distance C1 between the pendent arms 28 of engaging arms 27 and the outer periphery of the cylindrical part 17, the pinching of the push parts 23 with a small force allows the flexion of the connecting bridges 29. This ensures that the engaging projections 25 of the engaging arms 27 are disengaged from the engaging recess 13 of the cylindrical part 9.

Furthermore, since in the first embodiment the cylindrical part 17 of the cap body 19 is fitted into the opening 11 of the cylindrical parts 9 of the cylinder head cover 3, the cylindrical part 17 presses outwardly the cylindrical part 9 through the O-ring 21. As a result, the engaging projections 25 of the pair of engaging arms 27 are certainly engaged with the engaging recess 13 of the cylindrical part 9 so that the cap 1 can reliably be prevented from being undesirably dislodged from the cylindrical part 9 of the cylinder head cover 3.

Furthermore, since in the first embodiment, the engaging recess 13 of the cylindrical part 9 of the cylinder head cover 3 is formed to have an annular shape, there is no need for aligning the engaging projections 25 of the engaging arms 27 with the engaging recess 13 prior to their engagement, which provides a simple attachment of the cap 1.

In the first embodiment, the O-ring 21 is seated into the sealing groove 17*a* recessed in the outer periphery of the cylindrical part 17 of the cap body 19. Alternatively, the sealing groove 17*a* may be recessed in the inner periphery of the cylindrical part 9 of the cylinder head cover 3 and the O-ring 21 may be seated into it.

Variant of Embodiment 1

Figure 6:
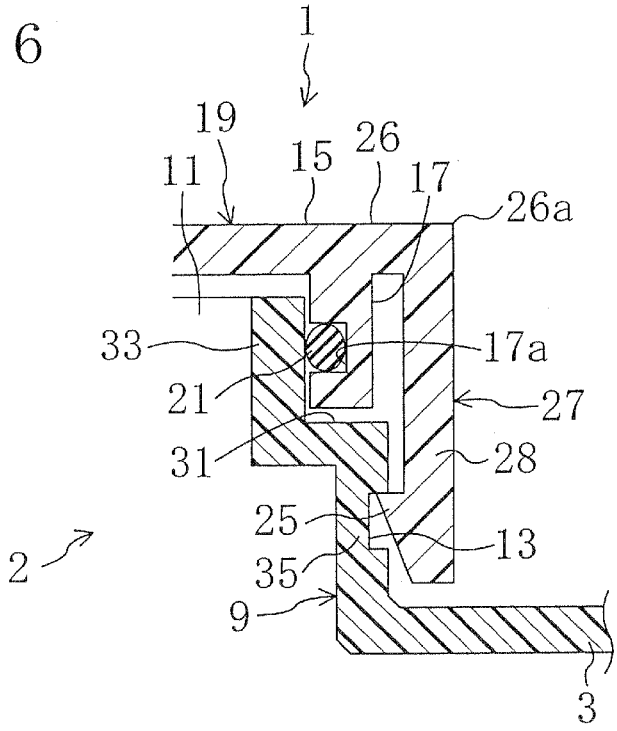
FIG. 6 is a cross-sectional view showing part of a cap mounting arrangement according to a variant of the first embodiment, which corresponds to a right half thereof in FIG. 3.

FIG. 6 shows a variant of the first embodiment of the invention.

In this variant, a shoulder 31 is provided in an axially intermediate portion of the cylindrical part 9 of the cylinder head cover 3, and the cylindrical part 9 is divided into a small-diameter part 33 forming an upper half and a large-diameter part 35 forming a lower half by the shoulder 31. Further, the cylindrical part 17 of the cap 1 is set at a length that locates very close to the shoulder 31 outside of the small-diameter part 33 of the cylindrical part 9 when it is engaged with the cylindrical part 9. Furthermore, the cylindrical part 17 is formed at its inner periphery with a sealing groove 17*a* into which an O-ring 21 is seated. In short, in this variant, the cylindrical part 17 of the cap 1 is fitted on the small-diameter part 33 of the cylindrical part 9 of the cylinder head cover 3. Since the structures other than the above points are the same as in the first embodiment, the same parts are identified by the same reference numerals and their detailed description is not given.

Therefore, this variant can produce the same effects as in the first embodiment.

In the first embodiment and the above variant thereof, a cylinder head cover is used as a container to which the cap is applied. Containers applicable to the cap are not limited to cylinder head covers, but may be vehicle fuel tanks, power steering oil tanks, various kinds of tanks not for use with vehicles, and various kinds of covers.

Embodiment 2

Cap Mounting Arrangement

Figure 7:
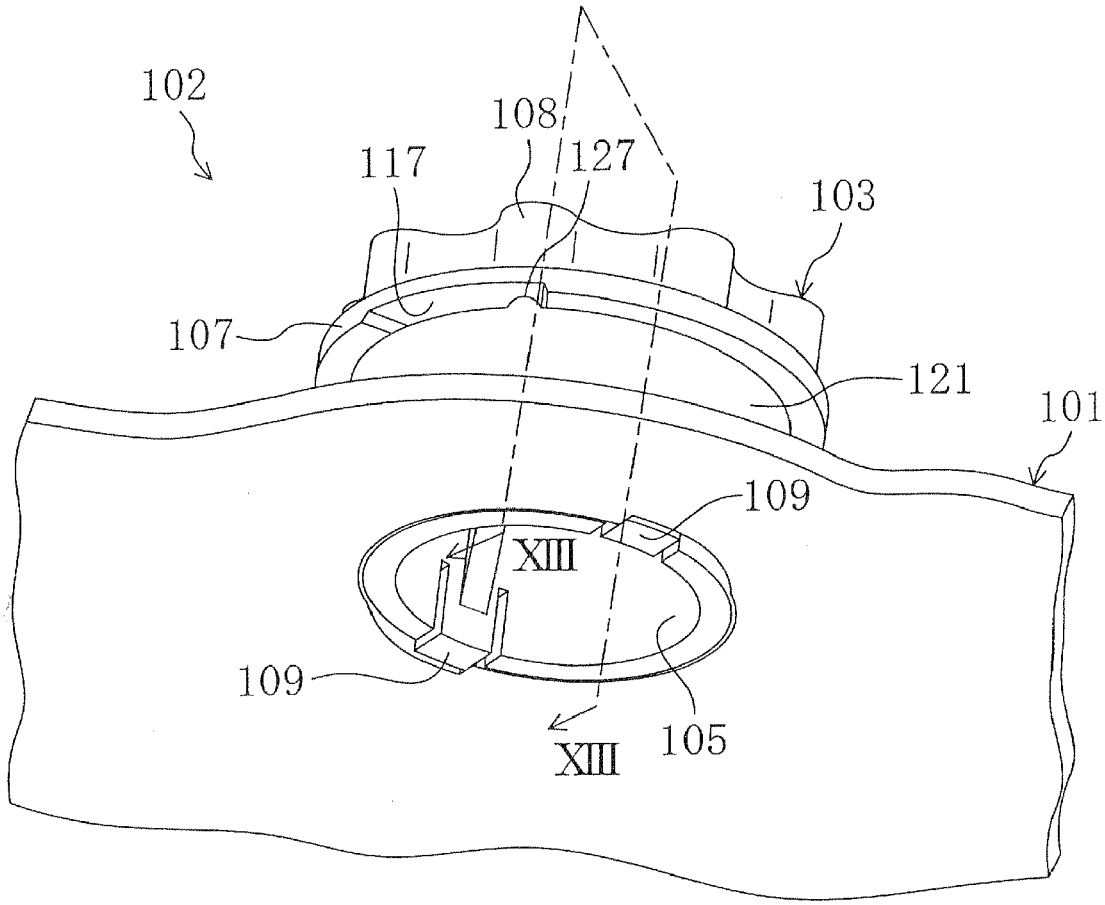
FIG. 7 is a perspective view of a cap mounting arrangement according to a second embodiment of the present invention when viewed below.
Figure 8:
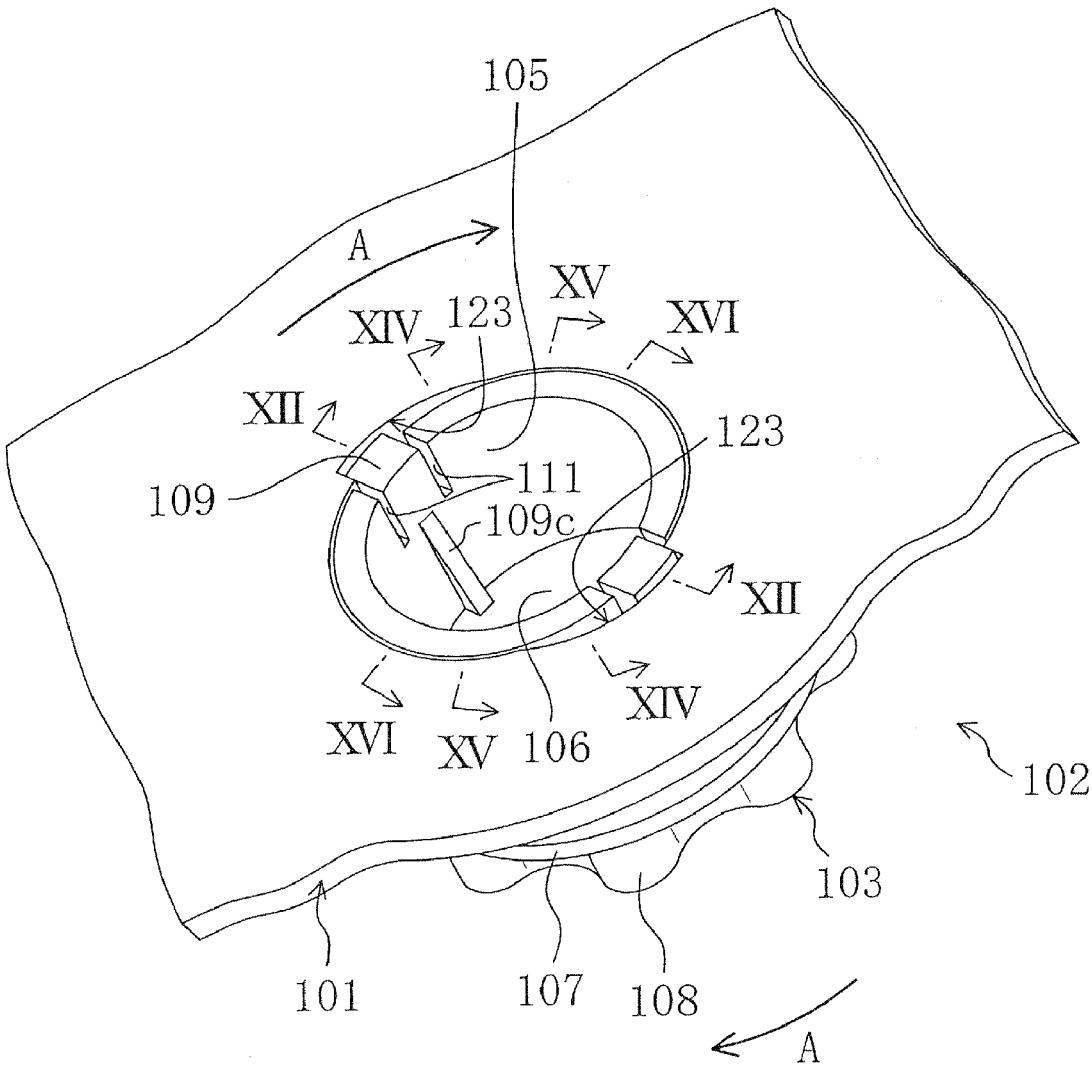
FIG. 8 is a view of the cap mounting arrangement corresponding to FIG. 7 when viewed along another direction.

FIGS. 7 and 8 show a cap mounting arrangement 102 for engine oil filling provided in a cylinder head cover 101 for a vehicle engine (not shown). The cylinder head cover 101 and the cap 103 are resin molded articles. The cylinder head cover 101 is for covering a cylinder head (not shown) for an engine and forms a container with the cylinder head.

Figure 9:
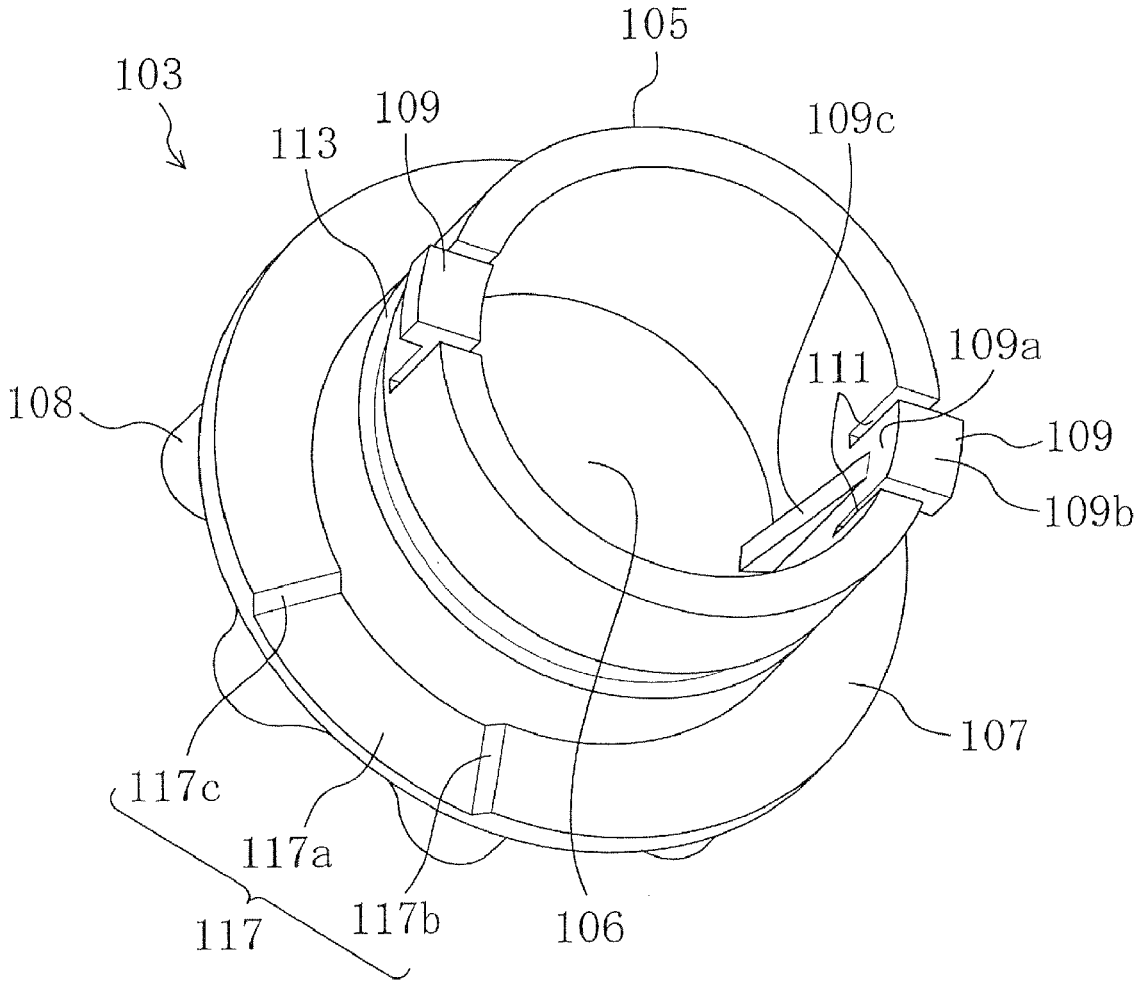
FIG. 9 is a perspective view of the cap when viewed from below.

As shown in FIG. 9, the cap 103 comprises an insert part 105 having a cylindrical shape closed at one end by a disk-like flat part 106, and an annular flange 107 provided at the closed end of the insert part 105. Reference numeral 108 denotes a grip which can be held by fingers to facilitate operations of turning the cap 103.

At opposite positions located on the outer periphery of the insert part 105 and at the forward end thereof in the direction of insertion, two radially expandable and contractible engaging parts 109 are provided respectively to project radially from the outer periphery of the insert part 105. Each engaging part 109 consists of a body 109*a* interposed between two slits 111 indented linearly from the distal end of the sidewall of the insert part 105 toward the proximal end thereof, and a projection 109*b* extending radially outwardly from the end of the body 109*a* and projecting beyond the outer periphery of the insert part 105. The engaging parts 109 can be expanded and contracted radially by the inclination of the body 109*a*. Further, in order to reinforce the roots (proximal ends) of the engaging parts 109, ribs 109*c* are provided on parts of the inner periphery of the insert part 105 located closer to the proximal end thereof than the bodies 109*a* of the engaging parts 109, respectively, to radially inwardly rise toward the proximal end of the insert part 105.

Figure 12:
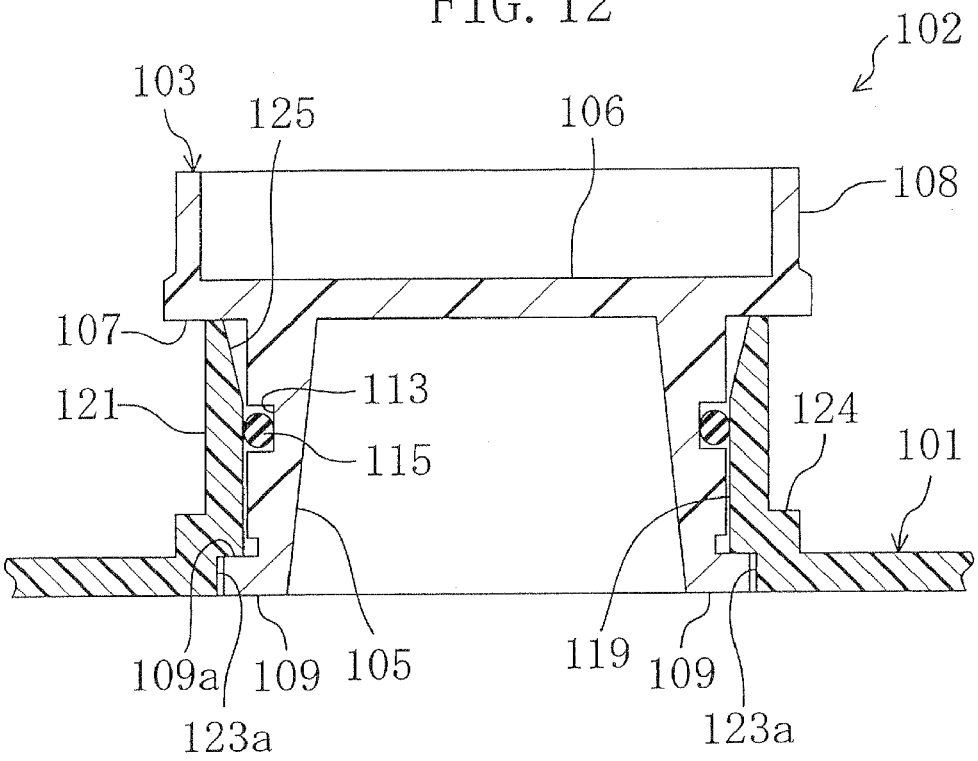
FIG. 12 is a cross-sectional view taken along the line XII-XII of FIG. 8.

As shown in FIG. 12, a sealing groove 113 of rectangular cross section is formed in the outer periphery of the insert part 105 between the engaging parts 109 and the flange 107 to go around the entire circumference thereof. An O-ring 115 serving as a sealing member is seated into the sealing groove 113 to hermetically close the opening 119 of the cylinder head cover 101.

As shown in FIG. 9, the back side of the flange 107 is formed with receiving recesses 117 located at two opposite positions a predetermined angle away from engaging parts 109, respectively. Each receiving recess 117 has a flat bottom 117*a* and a projection climbing surface 117*b* gradually decreasing its depth from the bottom 117*a* in the circumferential direction.

Figure 10:
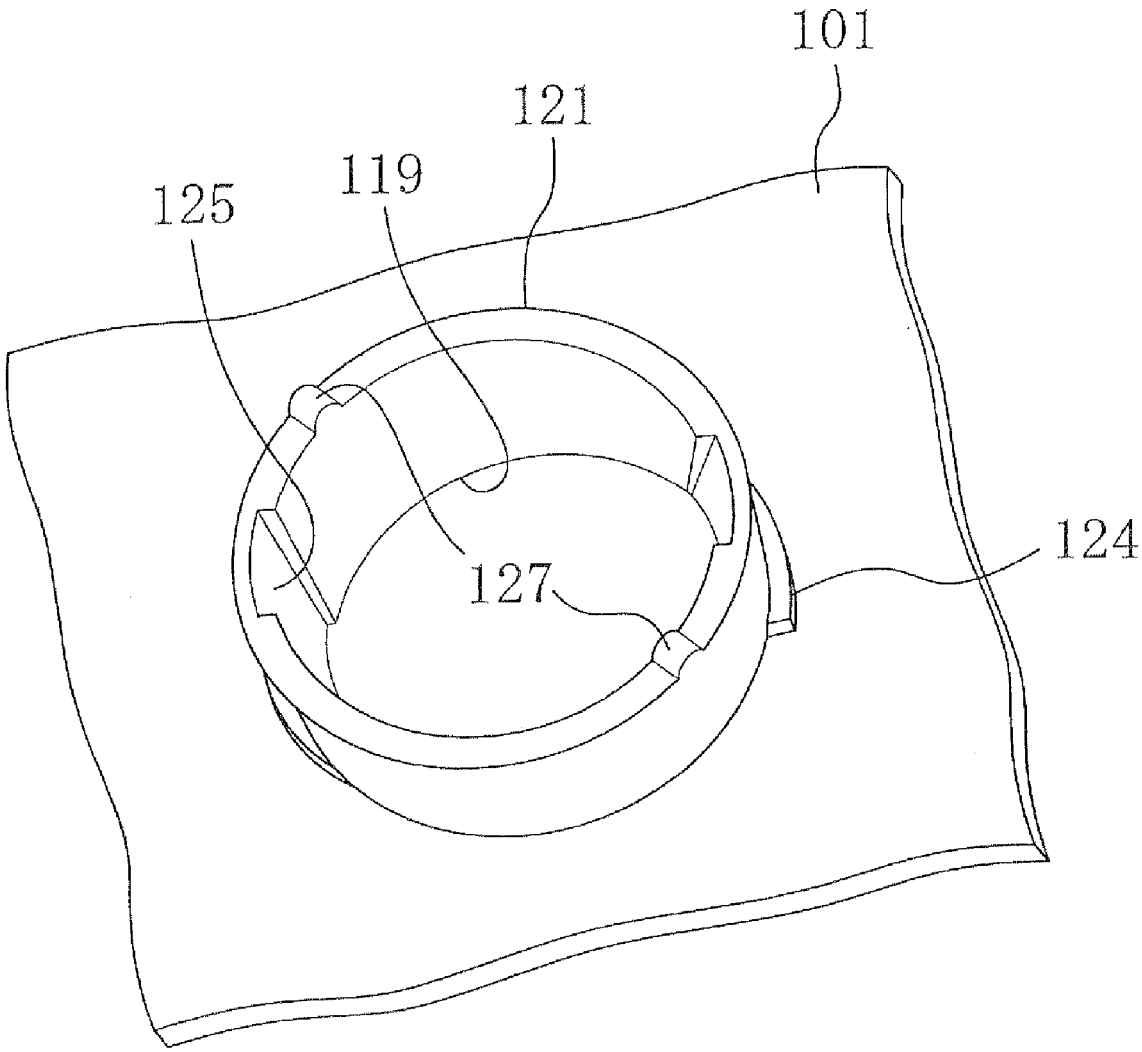
FIG. 10 is a perspective view of the cylindrical part of the cylindrical head cover when viewed from above.

On the other hand, as shown in FIG. 10, the opening 119 of the cylinder head cover 101 is provided with a cylindrical part 121 projecting externally from the cylinder head cover 101. The cylindrical part 121 has no raised portion on its inner periphery. During insertion of the cap 103 into the cylindrical part 121, the insert part 105 comes into close contact with the inner periphery of the cylindrical part 121 with the engaging parts 109 contracted radially inwardly.

Figure 11:
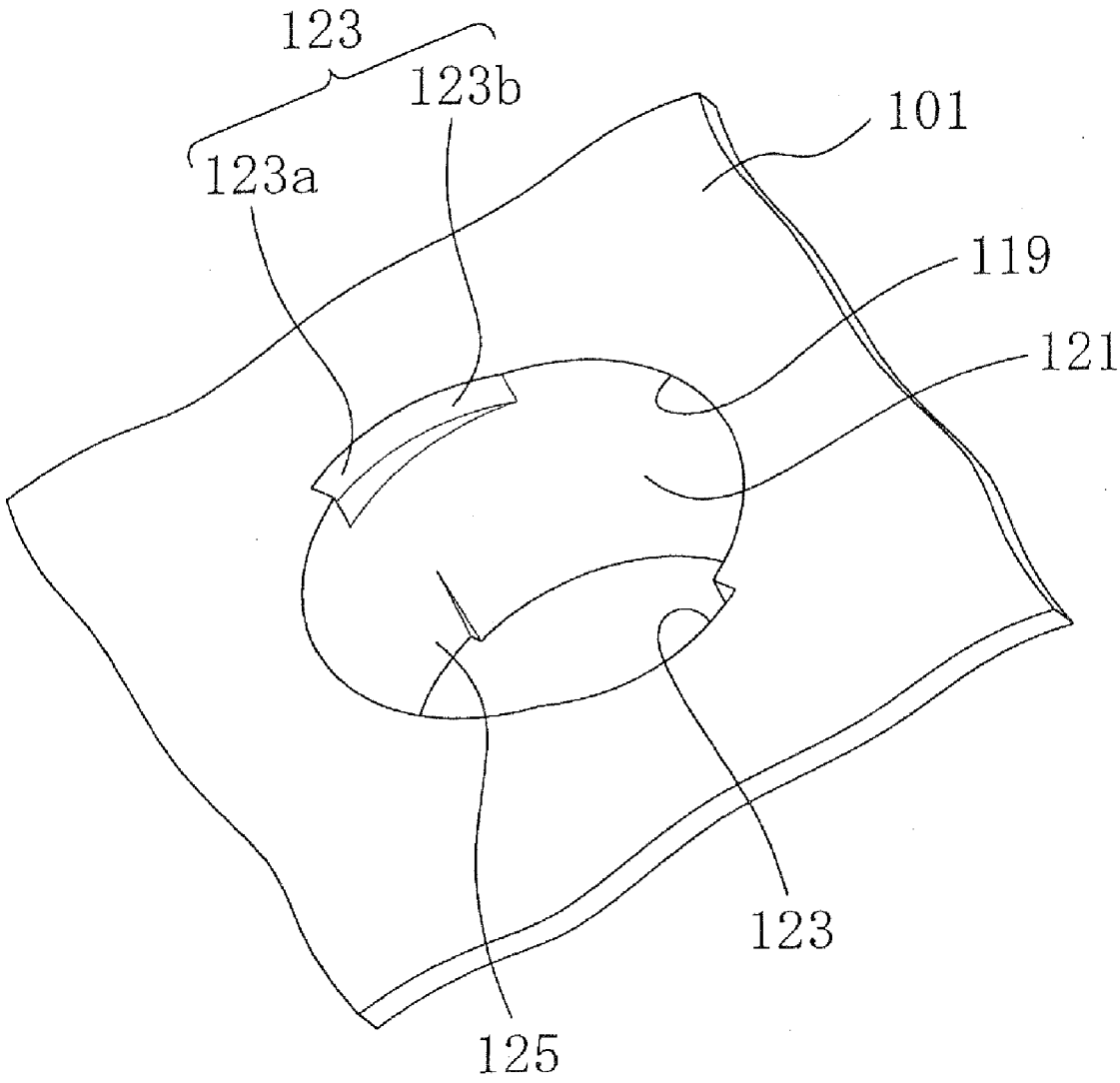
FIG. 11 is a perspective view of the cylindrical part of the cylindrical head cover when viewed from below.

As shown in FIG. 11, at opposite positions of the internal end of the inner periphery of the cylindrical part 121, two engaging grooves 123 are formed respectively. Each engaging groove 123 has a deepest part 123*a* capable of engagement with one of the engaging parts 109 of the cap 103 with the engaging part 109 expanded radially outwardly. Specifically, when the insert part 105 is inserted into the cylindrical part 121 with the engaging parts 109 contracted radially inwardly and then reaches the deepest parts 123*a*, the engaging parts 109 are released radially outwardly and snapped into the deepest parts 123*a*, which prevents the cap 103 from getting out of the cylindrical part 121.

Each engaging groove 123 also has a guide 123*b* extending to gradually decrease its radial depth from the deepest part 123*a* in the circumferential direction (shown in the arrow A in FIG. 8). Thus, when the cap 103 is turned in the direction of arrow A in order to remove the cap 103, the engaging parts 109 engaged into the deepest parts 123*a* can be gradually contracted radially inwardly to cancel the engaged relation with the cylindrical part 121, thereby removing the cap 103 from the cylindrical part 121.

As shown in FIG. 10, the outer periphery of the cylindrical part 121 is formed with reinforcement ribs 124 extending outwardly to correspond to the engaging grooves 123, respectively, in order to reinforce the cylindrical part 121.

Further, as shown in FIGS. 10 and 12, the external end of the inner periphery of the cylindrical part 121 is formed with inserting recesses 125 extending linearly to gradually decrease their radial depth toward the deepest parts 123*a* of the engaging grooves 123, respectively. Thus, in inserting the cap 103 into the cylindrical part 121, when the engaging parts 109 are inserted into the inserting recesses 125 and pushed in while being radially inwardly changed in position, they are guided toward the deepest parts 123*a* of the engaging grooves 123, respectively.

Figure 13:
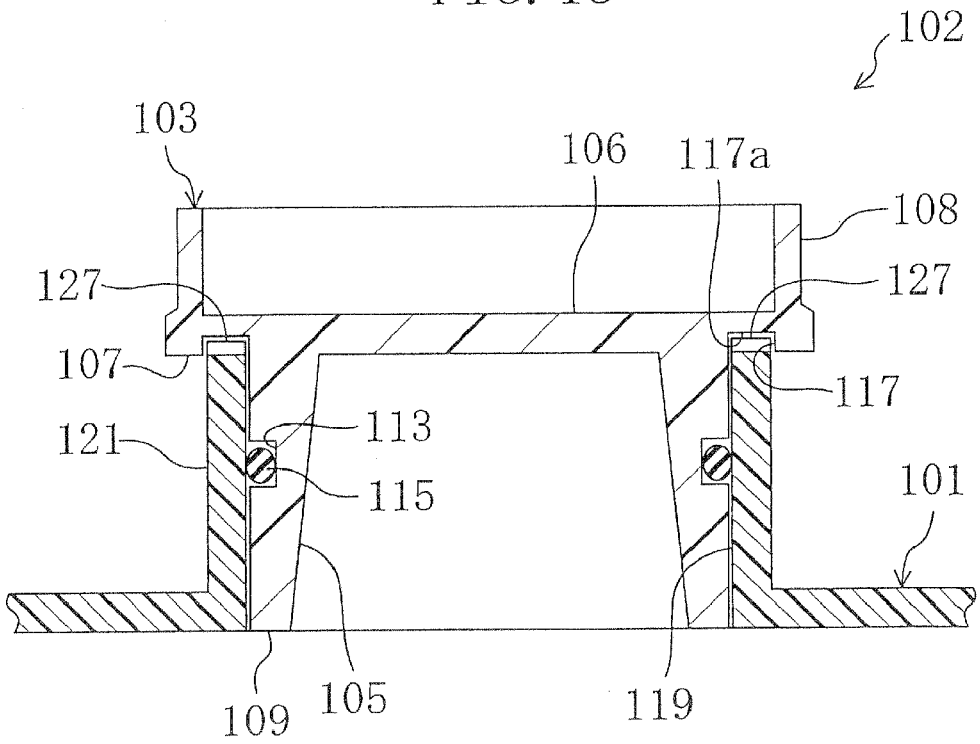
FIG. 13 is a cross-sectional view taken along the line XIII-XIII of FIG. 7.

Furthermore, as shown in FIG. 10, the external end surface of the cylindrical part 121 is provided with push-out projections 127 having a round top. As shown in FIG. 13, the push-out projections 127 are accommodated in the bottoms 117*a* of the receiving recesses 117, respectively, when the cap 103 closes the opening 119 and the back side of the flange 107 abuts on the external end surface of the cylindrical part 121.

Out of the pair of opposed wall surfaces of the receiving recess 117, the wall surface 117*c* moving away from the push-out projection 127 during turning of the cap 103 for removal may be formed to extend perpendicular to the bottom 117*a*.

Cap Attachment and Detachment

In attaching the cap 103 to the cylindrical part 121 of the cylinder head cover 101, the cap 103 is first inserted toward the inside of the cylindrical part 121 to fit the engaging parts 109 of the insert part 105 into the inserting recesses 125 of the cylindrical part 121.

During the time, the engaging parts 109 of the insert part 105 slide in the inserting recesses 125 toward the deepest parts 123*a* of the engaging grooves 123, respectively, while changing their positions radially inwardly.

As shown in FIG. 12, when the engaging parts 109 then reach the deepest parts 123*a*, the engaging parts 109 having been contracted radially inwardly are released radially outwardly to expand and engage with the deepest parts 123*a*, respectively. Concurrently, the O-ring 115 is brought into contact with the inner periphery of the cylindrical part 121, and the cap 103 is thereby attached to the cylindrical part 121 in a manner tightly inserted thereinto.

At this time, as shown in FIG. 13, the push-out projections 127 of the cylindrical part 121 are accommodated in the bottoms 117*a* of the receiving recesses 117, respectively, formed in the back side of the flange 107 of the cap 103.

Figure 14:
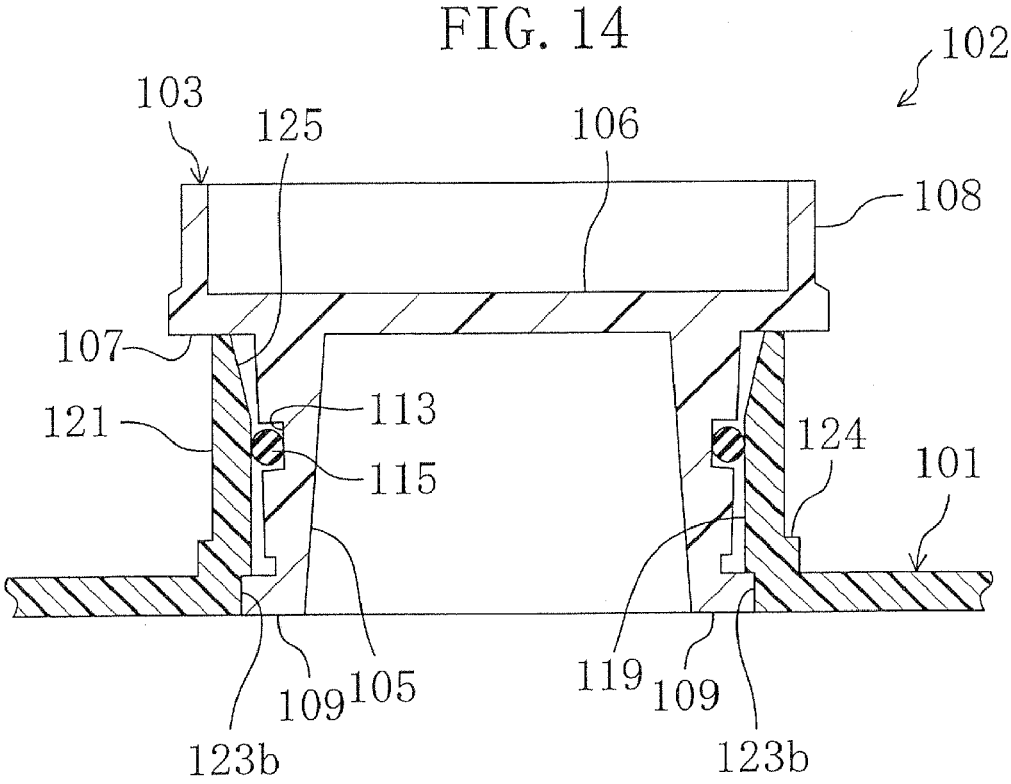
FIG. 14 is a cross-sectional view taken along the line XIV-XIV of FIG. 8.
Figure 15:
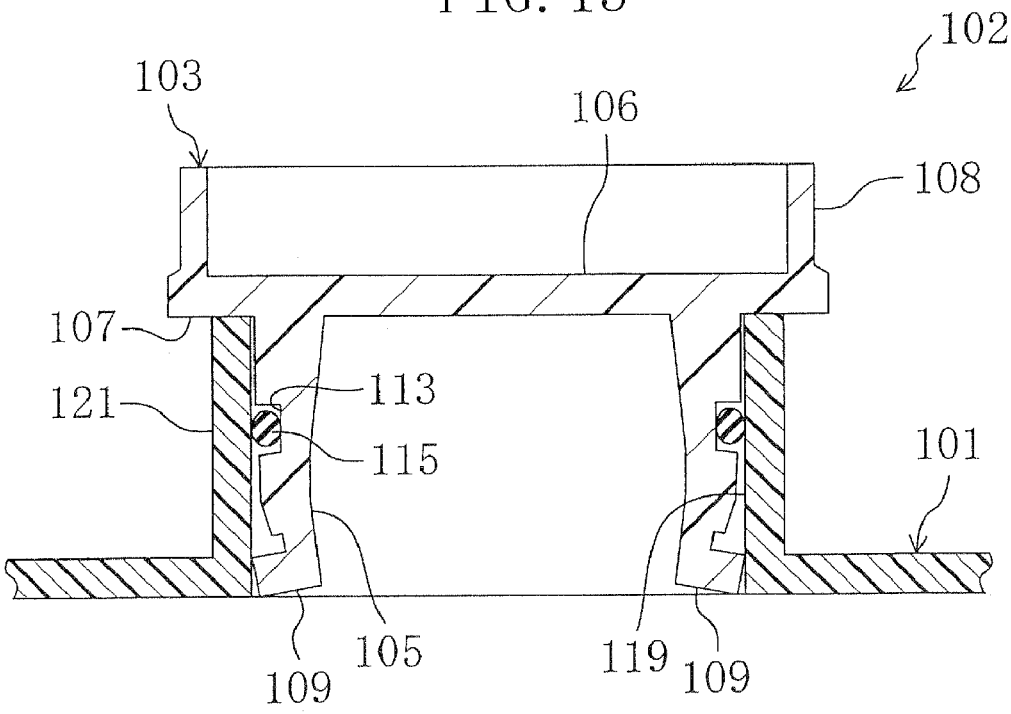
FIG. 15 is a cross-sectional view taken along the line XV-XV of FIG. 8.

In detaching the cap 103 from the cylindrical part 121 of the cylinder head cover 101, the cap 103 is first turned as shown in the arrow A in FIG. 8, thereby sliding the engaging parts 109, which is engaged with the deepest parts 123*a*, along the guides 123*b* of the engaging grooves 123, respectively (see FIG. 14). When the cap 103 is further turned, the engaging parts 109 are contracted radially inwardly as shown in FIG. 15 so that the cap 103 can be removed.

Figure 16:
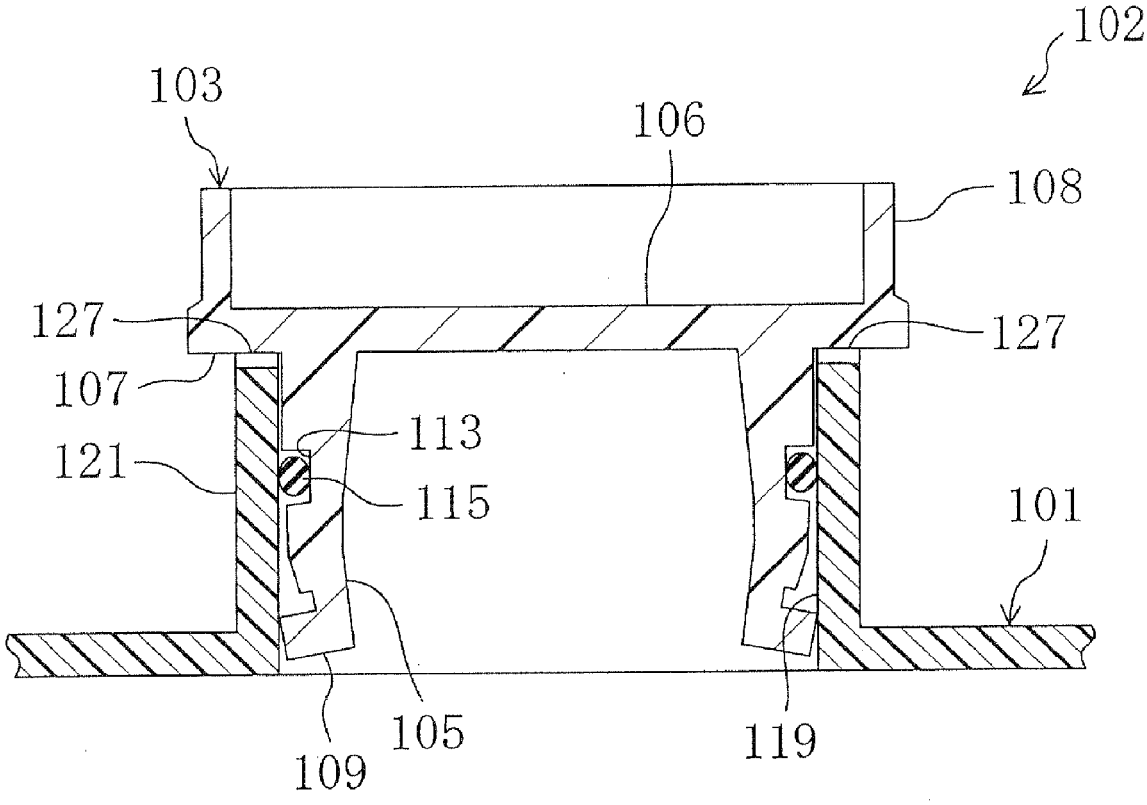
FIG. 16 is a cross-sectional view taken along the line XVI-XVI of FIG. 8.

When the cap 103 is still further turned, as shown in FIG. 16, the projection climbing surfaces 117*b* of the receiving recesses 117 of the cap 103 approach the push-out projections 127 of the cylindrical part 121 which have been accommodated in the bottoms 117*a* of the receiving recesses 117, and then climb on them. As a result, the cap 103 is pushed toward outside the cylindrical part 121 by the height of the push-out projection 127.

Then, the cap 103, which has been thus pushed outwardly and has become easily removable, is pulled out of the cylinder head cover 101.

Effects of Embodiment 2

According to the cap mounting arrangement 102 of the second embodiment, the cap 103 is inserted into the cylindrical part 121 of the cylinder head cover 101 without a turning operation so that it can be engaged therewith and held engaged. In the detachment of the cap 103, the cap 103 is slightly turned so that the engaging parts 109 are contracted radially inwardly and disengaged from the engaging grooves 123 to cancel the engagement of the engaging parts 109. Then, the cap 103 can be removed from the cylindrical part 121 by pulling it up. Therefore, the cap 103 can be attached to the cylindrical part 121 simply by inserting the cap 103 into the cylindrical part 121 and can be detached from the cylindrical part 121 simply by slightly turning the cap 103 and then pulling it up. In this way, a cap mounting arrangement 102 can be provided which has extremely easy attachment and detachment operations. Further, since the cylindrical part 121 into which the cap 103 is to be inserted is formed with neither threaded part nor engaging hole, there is no need for proving for any sliding platen in a mold for forming the inner surface of the cylindrical part 121, which provides an inexpensive cap mounting arrangement 102.

Furthermore, during insertion of the cap 103 into the cylindrical part 121, the engaging parts 109 of the cap 103 are guided toward the deepest parts 123*a* of the engaging grooves 123 by the inserting recesses 125 formed in the external end surface of the cylindrical part 121. Therefore, the insertion of the cap 103 into the cylindrical part 121 can be further facilitated and the engaging parts 109 of the cap 103 can reliably be engaged into the deepest parts 123*a*.

Furthermore, in pulling the cap 103 out of the cylindrical part 121 of the cylinder head cover 101 by turning it, the engaging parts 109 of the cap 103 having been engaged into the deepest parts 123*a* of the engaging grooves 123 of the cylindrical part 121 are first disengaged from the engaging grooves 123 and then the push-out projections 127 provided on the external end surfaces of the cylindrical part 121 are climbed on the projection climbing surfaces 117*b* of the receiving recesses 117 provided in the back side of the flange 107 of the cap 103 to push the cap 103 toward outside the cylindrical part 121. Thus, the cap 103 is pushed toward outside the cylindrical part 121 by the height of the push-out projections 127 using a force to turn the cap 103. Therefore, the cap 103 can easily be pulled out.

Variant of Embodiment 2

The second embodiment of the present invention may have the following configurations.

Though the container is a cylinder head cover 101 in the second embodiment, the present invention is applicable to any container having a cylindrical part with an opening.

In the second embodiment, each receiving recess 117 is provided with a projection climbing surface 117*b* gradually decreasing its depth from the bottom 117*a* in the circumferential direction and each push-out projection 127 has a rounded top surface. Instead of this, the projection climbing surface 117*b* may be formed perpendicular to the bottom 117*a* or the push-out projection 127 may be a rectangular column. On the contrary, the top surface of the push-out projection 127 closer to the projection climbing surface 117*b* may be formed into an inclined flat surface (or curved surface) while the projection climbing surface 117*b* may be formed perpendicular to the bottom 117*a*. In short, it is essential only that either one of the push-out projection 127 and the projection climbing surface 117*b* has an inclined surface so that the projection climbing surface 117*b* can be climbed smoothly on the push-out projection 127.

In the second embodiment, the back side of the flange 107 of the cap 103 is formed with receiving recesses 117 while the external end surface of the cylindrical part 121 is provided with push-out projections 127. On the contrary, the back side of the flange 107 of the cap 103 may be provided with push-out projections 127 while the external end surface of the cylindrical part 121 may be formed with receiving recesses 117.

Though in the second embodiment two engaging parts 109 are provided at opposite positions, respectively, of the insert part 105 of the cap 103, the positions of the two engaging parts 109 are not limited thereto. Further, the number of engaging parts provided may be singular or more than two. In these cases, the number of engaging grooves or inserting recesses of the cylindrical part may correspond to the number of engaging parts.

Though in the second embodiment the engaging grooves 123 are recessed at the internal end of the inner periphery of the cylindrical part 121, they may be formed somewhere in the intermediate region of the cylindrical part 121 located below the sealing groove 113. Also in such a case, if no walls are provided in portions of the inner periphery of the cylindrical part 121 located right below (i.e., more internally than) the engaging grooves 123 and the engaging grooves 123 are continued to the internal end of the cylindrical part 121, the engaging grooves 123 do not have undercut profiles. Therefore, even if the mold does not include a sliding platen, the cylinder head cover 101 after molded can be removed from the mold.

In the second embodiment, the opposed sidewalls of each inserting recess 125 of the cylindrical part 121 extend with the same distance between them toward the corresponding deepest part 123*a* of the engaging groove 123. The opposed sidewalls of each inserting recess 125 may be formed to gradually diminish their distance toward the corresponding deepest part 123*a* of the engaging groove 123.

In the second embodiment, the cylindrical part 121 is projected externally from the wall of the cylinder head cover 101 serving as a container. However, the cylindrical part 121 may be projected internally from the wall of the container and the opening may be flush with the wall.

Though in the second embodiment the guide 123*b* of each engaging groove 123 extend to gradually decrease its radial depth from the deepest part 123*a* clockwise in FIG. 11, it may extend in the same manner counterclockwise in FIG. 11. In this case, since the direction to turn the cap 103 for removal is reversed, the receiving recesses and push-out projections may be provided correspondingly.

What is claimed is:

1. A cap mounting arrangement comprising a cylindrical part integrally extended from a container to have an opening and a cap detachably attached to the cylindrical part to hermetically close the cylindrical part, wherein the cap comprises:

a cap body fitted into the cylindrical part through a sealing member;

a pair of L-shaped, flexible engaging arms that extend radially outwardly from two opposite points existing on a circumferential edge of the outer periphery of the cap body opposite to the direction of fitting and equally away from the center of the cap body and then extend in the direction of fitting from the radially outwardly extending ends of the engaging arms with a distance away from the outer periphery of the cap body, the distal ends of the engaging arms having engaging projections, respectively, engaged with an engaging recess formed in the outer periphery of the cylindrical part; and a pair of flexible connecting bridges that connect the distal ends of the pair of engaging arms to surround the outer periphery of the cap body with a distance away therefrom, and the cap mounting arrangement is configured so that in attaching the cap to the cylindrical part, the fitting of the cap body into the cylindrical part and the engagement of the engaging projections of the pair of engaging arms with the engaging recess are carried out by pushing an end of the cap body opposite to the direction of fitting, and that in detaching the cap from the cylindrical part, the pair of engaging arms are flexed to get away from the outer periphery of the cylindrical part to disengage the engaging projections from the engaging recess of the cylindrical part by pushing circumferentially middle parts of the pair of connecting bridges together to come close to each other.

2. The cap mounting arrangement of claim 1, wherein the distance between the circumferentially middle parts of the pair of connecting bridges and the outer periphery of the cap body is set larger than the distance between the pair of engaging arms and the outer periphery of the cap body.

3. The cap mounting arrangement of claim 2, wherein the cap body is configured so as to be fitted into the opening of the cylindrical part.

4. The cap mounting arrangement of claim 1, wherein the cap body is configured so as to be fitted into the opening of the cylindrical part.

* * * * *